US009925638B2

(12) United States Patent
Li et al.

(10) Patent No.: US 9,925,638 B2
(45) Date of Patent: Mar. 27, 2018

(54) MINIMAL QUANTITY LUBRICATION GRINDING DEVICE INTEGRATING NANOFLUID ELECTROSTATIC ATOMIZATION WITH ELECTROCALORIC HEAT PIPE

(71) Applicant: QINGDAO TECHNOLOGICAL UNIVERSITY, Qingdao, Shandong Province (CN)

(72) Inventors: Changhe Li, Qingdao (CN); Benkai Li, Qingdao (CN); Yaogang Wang, Qingdao (CN); Min Yang, Qingdao (CN); Yanbin Zhang, Qingdao (CN)

(73) Assignee: QINGDAO TECHNOLOGICAL UNIVERSITY, Qingdao (CN)

( * ) Notice: Subject to any disclaimer, the term of this patent is extended or adjusted under 35 U.S.C. 154(b) by 144 days.

(21) Appl. No.: 15/102,801

(22) PCT Filed: Dec. 1, 2015

(86) PCT No.: PCT/CN2015/096159
§ 371 (c)(1),
(2) Date: Jun. 8, 2016

(87) PCT Pub. No.: WO2016/197559
PCT Pub. Date: Dec. 15, 2016

(65) Prior Publication Data

US 2017/0120419 A1 May 4, 2017

(30) Foreign Application Priority Data

Jun. 9, 2015 (CN) ..... 2015 1 03121197
Jun. 9, 2015 (CN) ..... 2015 2 0393895X U

(51) Int. Cl.
*B24B 55/02* (2006.01)
*F25B 21/00* (2006.01)

(52) U.S. Cl.
CPC ..... *B24B 55/02* (2013.01); *F25B 21/00* (2013.01); *F25B 2321/001* (2013.01)

(58) Field of Classification Search
CPC ..... B24B 55/02; F25B 21/00; F25B 2321/001
See application file for complete search history.

(56) References Cited

FOREIGN PATENT DOCUMENTS

CN 100557340 C 11/2009
CN 203068865 U 7/2013
(Continued)

OTHER PUBLICATIONS

Mar. 15, 2016 International Search Report issued in International Patent Application No. PCT/CN2015/096159.
(Continued)

*Primary Examiner* — Marc Carlson
(74) *Attorney, Agent, or Firm* — Oliff PLC

(57) ABSTRACT

A minimal quantity lubrication grinding device including: heat pipe grinding wheel covered with electrocaloric film material on both side surfaces, wherein external electric field is applied to outside of the electrocaloric film material; and electrostatic atomization combined nozzle provided with high-voltage DC electrostatic generator and magnetic field forming device at the outside and in an electrocaloric refrigeration and magnetically enhanced electric field; electrostatic atomization combined nozzle is respectively connected with nanoparticle liquid and gas supply system; and nanofluid is electrostatically atomized by electrostatic atomization combined nozzle and is jet to grinding area to absorb heat of grinding area; electrocaloric film material absorbs heat in grinding area through electrocaloric effect and disperses absorbed heat through heat pipe grinding wheel after leaving grinding area to form a Carnot cycle. Nanofluid electrostatic atomization is integrated with electrocaloric refrigeration and heat pipe.

10 Claims, 13 Drawing Sheets

(56) References Cited

FOREIGN PATENT DOCUMENTS

| | | | | |
|---|---|---|---|---|
| CN | 103612207 | A | | 3/2014 |
| CN | 103128676 | B | * | 7/2015 |
| CN | 103612207 | A | * | 9/2015 |
| CN | 104875116 | A | | 9/2015 |
| CN | 204772104 | U | | 11/2015 |
| CN | 104526587 | B | * | 5/2016 |
| JP | 2004-216541 | A | | 8/2004 |
| JP | 2004216541 | A | * | 8/2004 |

OTHER PUBLICATIONS

Mar. 15, 2016 Written Opinion issued in International Patent Application No. PCT/CN2015/096159.

* cited by examiner

MINIMAL QUANTITY LUBRICATION GRINDING DEVICE INTEGRATING NANOFLUID ELECTROSTATIC ATOMIZATION WITH ELECTROCALORIC HEAT PIPE

FIELD OF THE INVENTION

The present invention relates to a grinding process and device, in particular to a minimal quantity lubrication grinding device integrating nanofluid electrostatic atomization with an electrocaloric heat pipe.

BACKGROUND OF THE INVENTION

Grinding is an important machining process of finish machining, the machining procedure thereof is to use a grinding wheel to interact with a workpiece, and since abrasive particles on the surface of the grinding wheel generally cut at negative rake angles, heat generated in the grinding procedure is much larger than that in other machining forms. When grinding the workpiece material, a large amount of mechanical energy consumed by the abrasive particles is converted into heat, only a small part of the heat on a grinding interface is taken away by a grinding shoulder, more than 90% of the heat is transferred to bodies of the grinding wheel and the workpiece, thereby generating serious influence on the service life of the grinding wheel and the use performance of the workpiece. Due to the grinding high temperature, the surface layers of the abrasive particles on the surface of the grinding wheel are weakened, and the abrasion is worsened, resulting in abrasive particle deviation and other phenomena and shortening the service life of the grinding wheel. When a large number of grinding heat is transferred to the workpiece, residual stress is formed on the surface layer very easily, and even cracks and other phenomena are generated on the surface, which influence the size precision and shape precision of the workpiece, when the temperature reaches a certain limit, the surface of the workpiece is subjected to grinding burn, and a metallographic structure on the surface layer of the workpiece is more likely to change, thereby seriously influencing the fatigue resistance and wear resistance of the workpiece, and reducing the usability and reliability of the workpiece. If the heat on the grinding interface cannot be dissipated in time, heat damage is generated easily.

Minimal quantity lubrication grinding is a green machining technology, it refers to a grinding technology in which an extremely small amount of lubrication fluid is mixed and atomized with a gas having a certain pressure, and then the mixture is jet to a grinding area for cooling and lubrication, and the cooling and chip removal functions are mainly realized by a high pressure gas. 30-100 ml of grinding fluid is adopted on a unit grinding wheel width of minimal quantity lubrication grinding, while 60 L/h of grinding fluid is adopted in pouring grinding; but minimal quantity lubrication reaches and even exceeds the pouring grinding effect, and meanwhile, the consumption of the grinding fluid is greatly reduced. Nanoparticle jet flow minimal quantity lubrication refers to adding a certain amount of nano solid particles in degradable minimal quantity lubrication oil on the basis of the minimal quantity lubrication to form nanofluid, atomizing the nanofluid though high pressure air and conveying the nanofluid into the grinding area in a jet flow manner. It can be seen from the enhanced heat transfer theory that, the heat transfer ability of solid is much larger than that of liquid and gas. The heat conductivity of a solid material at the normal temperature is larger than that of a fluid material for several orders of magnitudes, and the heat conductivity of liquid with suspended metal, non-metal or polymer solid particles is much larger than that of pure liquid. If the solid particles are added in a minimal quantity lubrication medium, the heat conductivity of the fluid medium can be greatly enhanced, the convective heat transfer ability can be improved and the defects of insufficient minimal quantity lubrication cooling ability can be greatly compensated. In addition, the nanoparticles (refer to ultrafine tiny solid particles having at least one dimension located in a nanometer scale (1-100 nm) in a three-dimensional space) further have special anti-wear antifriction and high carrying capacity and other tribological properties on lubrication and tribological aspects. The nano solid particles are added in the minimal quantity lubrication fluid medium to form the nanofluid, namely, the nanoparticles, lubrication liquid (oil, or oil-water mixture) and the high pressure gas mixture are jet into the grinding area in the jet flow manner after being mixed and atomized. The nanoparticle jet flow minimal quantity lubrication grinding is to provide a novel grinding process having the advantages of the minimal quantity lubrication technology and having stronger cooling performance and excellent tribological properties, and special equipment for realizing the process, the grinding burn can be effectively solved, the surface integrity of the workpiece can be improved, and low-carbon green and clean production with high efficiency, low consumption, environment friendliness and resource saving can be realized.

An electrocaloric effect is also called a thermoelectric effect, which changes the polarized state of a polar material under the action of an external electric field to generate an adiabatic temperature change or an isothermal change. The basic idea of the electrocaloric effect is to change the polarized state of the material under the action of the external electric field to change an entropy, so as to enable the material generate the temperature change. Therefore, the temperature can be regulated and controlled by changing the polarized state of the material through the external electric field, so as to realize refrigeration. The basic principle of refrigeration of the electrocaloric effect is to apply the electric field to the polar material, electric dipoles in the material become orderly from disorderly, the entropy of the material is reduced, and under an adiabatic condition, the excessive entropy generates temperature rise. If the electric field is removed, the electric dipoles in the material become disorderly from orderly, the entropy of the material is increased, and under an isothermal condition, the material absorbs heat from the outside to ensure energy conservation. Or, under the adiabatic condition, insufficient entropy causes temperature drop of the material, and the whole procedure is similar to a Carnot cycle. For an ideal refrigeration cycle, when the electric field is removed, the electrocaloric material can absorb heat (isothermal entropy) from a load in contact therewith. Then, the electrocaloric material is separated from the load, and at this time, the electric field is applied to the electrocaloric material, the temperature of the material will rise (adiabatic temperature change). The electrocaloric material is in contact with a cooling fin, and the excessive heat will be released, so that the temperature of the electrocaloric material is consistent with the room temperature. Then, the electrocaloric material is disconnected from the cooling fin and is in contact with the load. When the electric field is removed, the temperature of the electrocaloric material drops and the electrocaloric material absorbs heat from the load. The whole procedure is repeated, the temperature of the load will continuously drop. This is the basic principle of an electrocaloric refrigerator. At present, the electrocaloric refrigeration is widely used in micro electro mechanical systems (MEMS), and the electrocaloric refrigeration has the advantages of being simple in structure, free of mechanical moving parts, small in volume, especially suitable for partial cooling, high in startup speed, flexible to control, free of mechanical compression, high in refrigeration efficiency, low in cost, free of compressed gas or refrigerant and harmless to the environment, so that the electrocaloric refrigeration is a novel refrigeration technology having a brilliant development prospect.

Among numerous heat transfer elements, a heat pipe is one of the most efficient heat transfer elements known to people at present, it can rely on the phase change of its own internal working fluid to transmit a large amount of heat at a long distance through a very small sectional area without additional power. The so-called heat pipe grinding wheel refers to forming a heat pipe structure and function in a grinding wheel body by an appropriate method, so as to greatly improve the heat conductivity of the grinding wheel compared with that of the traditional common grinding wheel, and the heat of the cambered grinding area can be directly introduced into a heat pipe evaporation end and quickly dispersed by the heat transfer function of the heat pipe, so as to reduce the heat accumulation in the cambered grinding area and reduce the grinding temperature to avoid workpiece burn when efficient grinding is carried out on the workpiece material.

The Chinese Patent CN2013106349914 discloses nanoparticle jet flow controllable transport minimal quantity lubrication grinding equipment in a magnetically enhanced electric field, and a magnetic field is added around a corona area to improve the charge quantity of droplets; a high-voltage DC electrostatic generator and a nozzle of a magnetic field forming device are arranged at the outside of the equipment; the nozzle is connected with a nanoparticle liquid supply system and a gas supply system; the high-voltage DC electrostatic generator is connected with a negative electrode of an adjustable high-voltage DC power supply, and a positive electrode of the adjustable high-voltage DC power supply is connected with a workpiece energizing device attached to a non-machined surface of the workpiece to form a negative corona discharge form; the magnetic field forming device is arranged around the corona area of electrostatic discharge; when the grinding fluid is jet out from a spray head of the nozzle and is atomized to droplets, the droplets are charged under the action of the high-voltage DC electrostatic generator and the magnetic field forming device to convey the nanofluid into the grinding area. The electrostatic atomization nozzle adopted by the equipment is an integrated nozzle, which is relatively complex to machine and cannot be combined with other equipment, thereby requiring further improvement and optimization.

The Chinese patent CN200410009666.X discloses a micro refrigerator and a refrigeration method thereof, and particularly relates to a ferroelectric stack array micro refrigerator and a refrigeration method thereof. A relaxor ferroelectric material is used as a refrigerant, and the micro refrigerator is composed of n layers of ferroelectric stacks, m×1 ferroelectric stack arrays and n×m×1 unit refrigeration sheets in total; each refrigeration sheet adopts an electric field induced phase change refrigeration method of quickly adding an electric field and slowly removing the electric field; in different rows and columns, refrigeration sheets of the same layer or refrigeration sheets of every other layer work in the same manner, and the electric field adding (removing) work of the refrigeration sheets of each layer have a specific time sequence and cycle; and the ferroelectric stack arrays work alternately.

The Chinese patent CN201320028572.1 discloses a miniature refrigerator, including a refrigeration medium layer used for absorbing or releasing heat under the action of an electric field; the refrigeration medium layer is provided with a heat absorption end and a heat release end; a radiator used for releasing heat is connected with the heat absorption end of the refrigeration medium layer and a first heat switch for carrying out one-way heat transfer on the refrigeration medium layer through certain refrigeration equipment; a second heat switch for carrying out one-way heat transfer on the radiator through the refrigeration medium layer is located between the eat release end of the refrigeration medium layer and the radiator; and a heat isolation layer is covered on the peripheral outer surfaces of the refrigeration medium layer, the first heat switch and the second heat switch. The refrigerator is only suitable for local refrigeration of micro electromechanical equipment, and a refrigerator which reduces the temperature of a machining area by the electrocaloric effect is not involved in large equipment of machining such as grinding.

The Chinese Patent CN201310059826.0 discloses a heat pipe grinding wheel for dry grinding a difficult-to-machine material and a manufacturing method thereof, wherein the heat pipe grinding wheel includes a body and abrasive particles arranged on the body, and the body includes a base and an end cover; the abrasive particles are arranged on the end cover, and solid lubricants are coated on the abrasive particles; a heat pipe cavity is further formed between the end cover and the base, a degassing hole is formed on the base, and the degassing hole is communicated with the heat pipe cavity; a plug hole is formed at the outside of the degassing hole, and an inner plug and an outer plate, which are coaxially arranged, are arranged in the plug hole; a working medium is arranged in the heat pipe cavity; and condensate tanks are arranged on the outer surface located at a condensation segment of the heat pipe cavity of the end cover at intervals. The present invention can effectively disperse the heat in the cambered grinding area and can solve the bottleneck problem that the cooling liquid is unlikely to enter the cambered grinding area to effectively exchange heat.

The Chinese Patent CN201410707834.6 discloses a heat pipe grinding wheel for forming grinding, a heat pipe cavity is arranged in the grinding wheel, a working medium is filled in the heat pipe cavity, the inner wall surface of an evaporation end is close to a grinding surface of the grinding wheel, and a condensation end is away from the grinding surface of the grinding wheel; an independent vacuumizing interface and an endcapping interface are arranged on the end face of the grinding wheel, the vacuumizing interface is connected with a vacuumizing and liquid injecting device, the endcapping interface includes three channels, one channel is communicated with the external atmosphere, one channel is communicated with the vacuumizing interface through a degassing groove located in the grinding wheel, one channel is communicated with the heat pipe cavity through a degassing hole, the endcapping interface is matched with an endcapping module, after the endcapping module is installed, the endcapping interface is isolated from the external atmosphere, and the endcapping module controls the on-off of the degassing groove and the degassing hole in depth. The existing heat pipe grinding wheel has a good effect of reducing the temperature of the grinding area, but considering the heat exchange problem of the equipment cooperatively used with the grinding wheel for reducing the temperature of the grinding area, the structure of the heat pipe grinding wheel can be further improved.

SUMMARY OF THE INVENTION

The purpose of the present invention is to overcome the shortcomings of the prior art and provide a minimal quantity lubrication grinding device integrating nanofluid electrostatic atomization with an electrocaloric heat pipe. The device integrates an electrocaloric material and heat pipe refrigeration technology by an electrocaloric effect refrigeration method in grinding, and meanwhile cooperates with nanoparticle jet flow electrostatic atomization minimal quantity lubrication to further reduce the temperature of a grinding area, improve the machining quality of a workpiece and avoid heat damage to the workpiece. Wherein, the electrocaloric refrigeration is introduced into large machining equipment grinding, which has important reference significance on machining process, such as cutting, milling, drilling and other machining processes.

To achieve the above purpose, the present invention adopts the following technical solutions:

A minimal quantity lubrication grinding device integrating nanofluid electrostatic atomization with an electrocaloric heat pipe includes:

a heat pipe grinding wheel covered with an electrocaloric film material on both side surfaces, wherein an external electric field is applied to the outside of the electrocaloric film material; and an electrostatic atomization combined nozzle provided with a high-voltage DC electrostatic generator and a magnetic field forming device at the outside and in an electrocaloric refrigeration and magnetically enhanced electric field;

the electrostatic atomization combined nozzle is respectively connected with a nanoparticle liquid supply system and a gas supply system; and nanofluid is electrostatically atomized by the electrostatic atomization combined nozzle and is jet to a grinding area to absorb the heat of the grinding area; the electrocaloric film material absorbs the heat in the grinding area through an electrocaloric effect and disperses the absorbed heat through the heat pipe grinding wheel after leaving the grinding area to form a Carnot cycle.

An electric brush with an Sn/Ag electrode is arranged at the outside of the electrocaloric film material, and the external electric field is applied by the electric brush; the electric brush is fixed on a grinding wheel cover, and a positive electrode and a negative electrode of the electric brush are respectively in contact with the electrocaloric film material on both side surfaces of the heat pipe grinding wheel. A high-voltage electric field is formed between the positive electrode and the negative electrode of the electric brush and serves as a refrigeration hot end for releasing the heat through a heat pipe; and the grinding area is a refrigeration cold end and absorbs the heat through the electrocaloric film material.

The electrocaloric film material covers the entire outer surface of the heat pipe grinding wheel or covers a half of the area of the outer surface of the heat pipe grinding wheel.

The heat pipe of the heat pipe grinding wheel includes a cambered inner ring and a cambered outer ring, which are communicated at the middle, the cambered outer ring is arranged on the edge of the heat pipe grinding wheel, and the cambered inner ring is away from the edge of the grinding wheel. The cambered outer ring is a heat absorption end and can absorb the heat from the grinding area and the heat absorbed by the electrocaloric film material from the grinding area through the phase change refrigeration function of the fluid for cooling; and the cambered inner ring is a heat dissipation end for releasing the absorbed heat.

The electrostatic atomization combined nozzle includes an upper nozzle body and a lower nozzle body, and the upper nozzle body and the lower nozzle body are fixedly connected and are provided with sealing devices.

Combined nozzle plate electrodes are arranged in the upper nozzle body, a plate electrode insulating block is arranged for isolation between the two combined nozzle plate electrodes, and an insulating sleeve is sleeved on the outer side of the combined nozzle plate electrodes; a combined nozzle gas injection pipe is arranged in the upper nozzle body, and the combined nozzle gas injection pipe is communicated to the outside of the electrostatic atomization combined nozzle and is connected with a compressed air conveying serpentuator; and a combined nozzle liquid injection cavity is further arranged in the upper nozzle body, the lower part of the combined nozzle liquid injection cavity is connected with a combined nozzle orifice, and the combined nozzle liquid injection cavity is communicated to the outside of the electrostatic atomization combined nozzle through a pipeline and is connected with a nanofluid conveying serpentuator.

A gas injection hole is formed on the pipe wall of the combined nozzle gas injection pipe, and the central axis of the gas injection hole and the central axis of the combined nozzle gas injection pipe form an inclination angle of 15-35 degrees.

A combined nozzle mixing cavity is arranged in the lower nozzle body, and both ends of the combined nozzle mixing cavity are respectively connected with the combined nozzle gas injection pipe and a fan-shaped nozzle, and a conical acceleration section is arranged between the combined nozzle mixing cavity and the fan-shaped nozzle; and the high-voltage DC electrostatic generator and the magnetic field forming device are installed at the lower part of the fan-shaped nozzle.

The high-voltage DC electrostatic generator is connected with the negative electrode of an adjustable high-voltage DC power supply, and the positive electrode of the adjustable high-voltage DC power supply is connected with a workpiece energizing device attached to a non-machined surface of the workpiece to form a negative corona discharge form. The magnetic field forming device is located around a corona discharge area, and a magnet is fixed below L-shaped needle electrodes through a locating chuck to form field intensity at the middle to improve the charge quantity of nanofluid droplets.

The high-voltage DC electrostatic generator includes:

a circular electrode disk, wherein a combined nozzle electrode groove is arranged on the circular electrode disk, a plurality of needle electrode necks are arranged on the combined nozzle electrode groove at intervals, and the L-shaped needle electrodes are inserted in the needle electrode necks.

The magnetic field forming device is arranged at the lower part of the high-voltage DC electrostatic generator and includes:

a magnet placed in a combined nozzle magnet box and located by the locating chuck; and the magnet is a permanent magnet or an electromagnet, and if the magnet is the electromagnet, an electromagnet conducting wire is lead out by an integrated nozzle electromagnet conducting wire channel.

The power supply of the electric brush and the power supply of the combined nozzle plate electrode are connected with the adjustable high-voltage DC power supply, and a power supply signal conversion device is arranged between the power supply of the combined nozzle plate electrode and the adjustable high-voltage DC power supply to adapt to the use demand of the electrocaloric film material.

The electric brush includes an electric brush base, and the electric brush base is fixed on the grinding wheel cover; the electric brush base is connected with a supporting body, a conductive part is arranged at the front end of the supporting body, the conductive part is composed of a plurality of Sn/Ag elastic contact pieces, and a sliding part is arranged at the front end of the conductive part; and a projection part is arranged on the sliding part and forms contact friction with the electrocaloric film material.

The workpiece energizing device includes a workpiece energizing device insulating shell, a weight, a pressing permanent magnet and a pressing spring; the pressing permanent magnet is arranged on the workpiece energizing device insulating shell, the weight is arranged at the middle of the workpiece energizing device insulating shell through the pressing spring in a penetration manner, and a conducting wire connecting ring and a cotter pin slot are arranged at the end part exposed from the workpiece energizing device insulating shell.

The electrocaloric film material and an electrocaloric nano-powder material can include a ferroelectric material, an antiferroelectric material and a relaxor ferroelectric material, and the Curie temperature of the electrocaloric material is near the room temperature, thereby having a relatively large electrocaloric effect.

The present invention has the following beneficial effects: the minimal quantity lubrication grinding device integrating the nanofluid electrostatic atomization with the electrocaloric heat pipe of the present invention integrates the nanofluid electrostatic atomization with the electrocaloric refrigeration and heat pipe refrigeration technology, and the refrigeration effect of the grinding area is significantly improved, which can be specifically divided into four aspects: 1. the electrocaloric film material covered on the heat pipe grinding wheel absorbs the heat in the grinding area by means of the electrocaloric effect refrigeration principle, and meanwhile can absorb the grinding heat transferred into the grinding wheel body to reduce the temperature of the grinding area; 2. the heat pipe grinding wheel absorbs the heat in the grinding area through the phase change refrigeration function of the fluid, and meanwhile dissipates the heat from the electrocaloric film material; 3. the nanofluid is conveyed to the grinding area in a nanofluid jet flow minimal quantity lubrication electrostatic atomization mode, to reinforce the heat exchange ability of the grinding area through the higher heat transfer performance of solid nanoparticles and reduce the temperature of the grinding area; and 4. the electrocaloric nano-powder material is added in the nanofluid, that is, the electrocaloric nano-powder material arrives at the grinding area in a lower temperature state through electrostatic atomization by means of the electrocaloric effect, since the material generates an electrothermal temperature change under the action of the electric field, the excessive heat of the electrocaloric nano-powder is dispersed by the heat exchange of the nanofluid to reduce the temperature of the nanofluid, and thus the electrocaloric nano-powder material can absorb more grinding heat after arriving at the grinding area, in order to reduce the grinding temperature.

Figure 1:
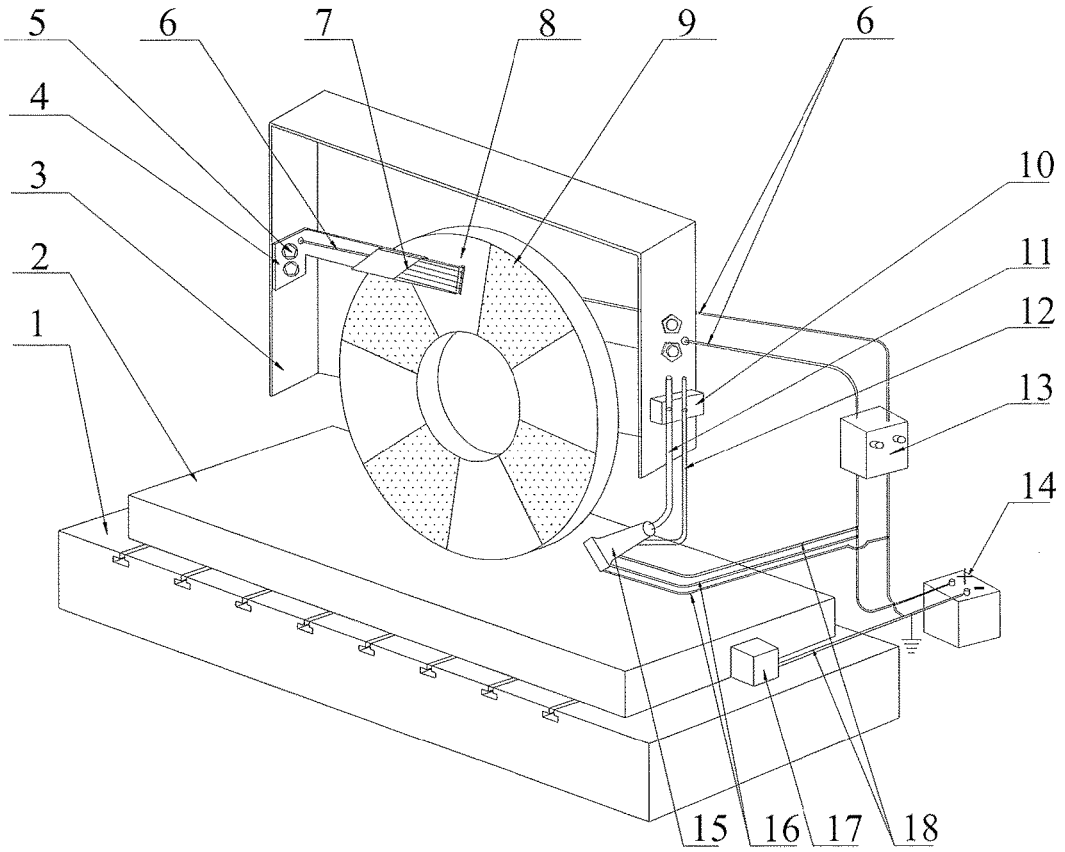
FIG. 1 is an isometric diagram of a nanoparticle jet flow minimal quantity lubrication electrostatic atomization and electrocaloric refrigeration grinding device.

In the figures, 1, magnetic worktable; 2, workpiece; 3, grinding wheel cover; 4, electric bush base; 5, electric bush fixing bolt; 6, electric bush conducting wire; 7, electric bush; 8, heat pipe grinding wheel; 9, electrocaloric film material; 10, conveying serpentuator fixing device; 11, compressed air conveying serpentuator; 12, nanofluid conveying serpentuator; 13, power supply signal conversion device; 14, power supply generation device; 15, combined nozzle; 16, high-voltage conducting wire of combined nozzle plate electrode; 17, workpiece energizing device; 18, high-voltage conducting wire of L-shaped needle electrode; 19, sealing cover plate; 20, degassing hole; 21, vacuum seal; 22, cambered heat pipe outer ring; 23, cambered heat pipe inner ring; 24, communication pipe of cambered heat pipe inner and outer rings; 25, seal joint; 26, plug; 27, sealing ring; 28, combined nozzle liquid injection cavity; 29, combined nozzle orifice; 30, insulating sleeve of combined nozzle plate electrode; 31, combined nozzle mixing cavity; 32, combined nozzle acceleration section; 33, lower nozzle body of combined nozzle; 34, fan-shaped nozzle outlet of combined nozzle; 35, combined nozzle electrode groove; 36, L-shaped needle electrode; 37, electromagnet conducting wire channel of combined nozzle; 38, combined nozzle fixing threaded hole; 39, locating chuck; 40, magnet; 41, combined nozzle magnet box; 42, circular electrode disk of combined nozzle; 43, high-voltage electrode conducting wire channel of combined nozzle; 44, combined nozzle gas injection pipe wall; 45, combined nozzle sealing washer; 46, combined nozzle plate electrode; 47, upper nozzle body of combined nozzle; 48, high-voltage conducting wire channel of combined nozzle plate electrode; 49, liquid injection channel joint of combined nozzle; 50, liquid injection channel of combined nozzle; 51, gas injection channel joint of combined nozzle; 52, gas injection channel of combined nozzle; 53, plate electrode insulating block; 54, rubber stopper; 55, conducting wire interface; 56, high-voltage electrode conducting wire through hole; 57, needle electrode neck; 58, high-voltage electrode conducting wire placement groove; 59, locating through hole; 60, magnet baffle; 61, electric bush base; 62, electric bush fixing through hole; 63, supporting body; 64, conducive part; 65, Sn/Ag elastic contact piece; 66, sliding part; 67, projection part; 68, protrusion part; 69, weight; 70, cotter pin slot; 71, conducting wire connecting ring; 72, pressing spring; 73, workpiece energizing device insulating shell; 74, pressing permanent magnet; 75, air compressor; 76, nanofluid storage tank; 77, gas storage tank; 78, hydraulic pump; 79, filter; 80, pressure gage; 81, throttle valve I; 82, turbine flowmeter I; 83, turbine flowmeter II; 84, throttle valve II; 85, pressure regulating valve I; 86, pressure regulating valve II; 87, overflow valve; 88, nanofluid recycling box.

DETAILED DESCRIPTION OF THE EMBODIMENTS

The present invention will be further illustrated below in combination with the accompany drawings and the embodiments.

The first embodiment of the present invention is as shown in FIG. 1, FIG. 2, FIG. 6*a*, FIG. 6*b*, FIG. 7 and FIG. 11 to FIG. 22, and is a nanoparticle jet flow minimal quantity lubrication electrostatic atomization and electrocaloric refrigeration grinding device. The electrostatic atomization and electrocaloric refrigeration grinding device includes a heat pipe grinding wheel 8 covered with an electrocaloric film material 9 on both side surfaces, nanofluid added with an electrocaloric nano-powder material and an electrostatic atomization combined nozzle 15 provided with a high-voltage DC electrostatic generator and a magnetic field forming device in an electrocaloric refrigeration and magnetically enhanced electric field; ferroelectric films covered on both side surfaces of the heat pipe grinding wheel absorb heat in a grinding area by the electrocaloric effect and disperse the absorbed heat through the heat pipe grinding wheel after leaving the grinding area to maintain a Carnot cycle, so as to continuously absorb the heat of the grinding area to reduce the temperature of the grinding area; meanwhile, the electrocaloric film material can also absorb a part of heat transferred to the heat pipe grinding wheel to reduce the temperature of the grinding wheel body; in addition, the heat pipe grinding wheel per se can absorb heat from the grinding area to reduce the temperature of the grinding area; the electrostatic atomization combined nozzle in the electrocaloric refrigeration and magnetically enhanced electric field cooperates with the nanofluid added with the electrocaloric nano-powder material, on one hand, the nanofluid is jet to the grinding area through electrostatic atomization to reinforce the heat exchange ability of the grinding area through the relatively high heat transfer performance of solid nanoparticles and reduce the temperature of the grinding area; on the other hand, ferroelectric nano-powder arrives at the grinding area in a lower temperature state by means of the electrocaloric effect, since the material generates an electrothermal temperature change under the action of the electric field, so the temperature per se is reduced, meanwhile the nanofluid is refrigerated to reduce the temperature of the nanofluid, and thus the ferroelectric nano-powder can absorb more grinding heat to reduce the grinding temperature after arriving at the grinding area; and the device integrates a plurality of cooling modes, can significantly reduce the temperature of the grinding area, greatly improves the machining quality of the workpiece and effectively avoids heat damage to the workpiece.

As shown in FIG. 1, the electrocaloric film material 9 is adhered on both side surfaces of the heat pipe grinding wheel 8, and an external electric field is applied through an electric brush 7 connected with an electric brush base 4 and provided with an Sn/Ag electrode; the electric brush 7 is connected with a power supply signal conversion device 13 and a power supply generation device 14 through an electric brush conducting wire 6 for providing electric energy; the power supply signal conversion device 13 converts a DC high-voltage power supply signal into a pulse power supply signal to apply the external electric field to the electrocaloric film material 9 in the first embodiment; the electric brush base 4 is fixed on a grinding wheel cover 3 through an electric brush fixing bolt 5, wherein a positive electrode and a negative electrode of the electric brush 7 are respectively in contact with the electrocaloric film material 9 on both side surfaces of the heat pipe grinding wheel 8; and a high-voltage electric field is formed between the positive electrode and the negative electrode of the electric brush 7 and serves as a refrigeration hot end for releasing the heat through a heat pipe; and the grinding area is a refrigeration cold end and absorbs the heat through the electrocaloric film material 9. The combined nozzle 15 is connected with a compressed air conveying serpentuator 11 and a nanofluid conveying serpentuator 12, and the compressed air conveying serpentuator 11 and the nanofluid conveying serpentuator 12 are fixed by a conveying serpentuator fixing device 10; and a combined nozzle plate electrode 16 and an L-shaped needle electrode 36 in the combined nozzle 15 are respectively connected with a high-voltage conducting wire 16 of the combined nozzle plate electrode and a high-voltage conducting wire 18 of the L-shaped needle electrode and is connected with the power supply generation device 14. The power supply of the electric brush is integrated with the power supply of the electric field plate electrode of the upper nozzle body of the combined nozzle and the power supply of the high-voltage DC electrostatic generator, and each power supply is an adjustable high-voltage DC power supply.

Figure 2:
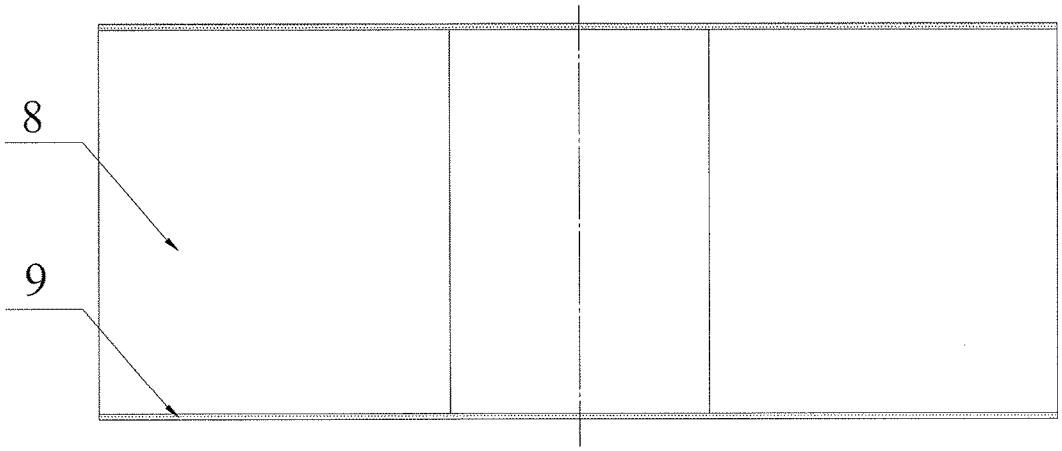
FIG. 2 is a top view of arrangement of an electrocaloric film of a grinding wheel in a first embodiment.

FIG. 2 is a top view of arrangement of an electrocaloric film of a grinding wheel in the first embodiment, and the electrocaloric film material 9 covers both side surfaces of the entire heat pipe grinding wheel 8.

Figure 6A:
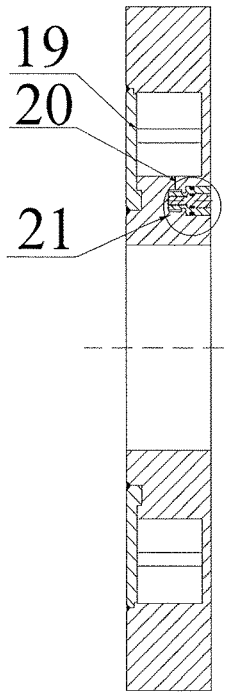
FIG. 6*a* and FIG. 6*b* are a rotary section view and a front view of a structure of a heat pipe grinding wheel in the first, second, third and fourth embodiments.
Figure 6B:
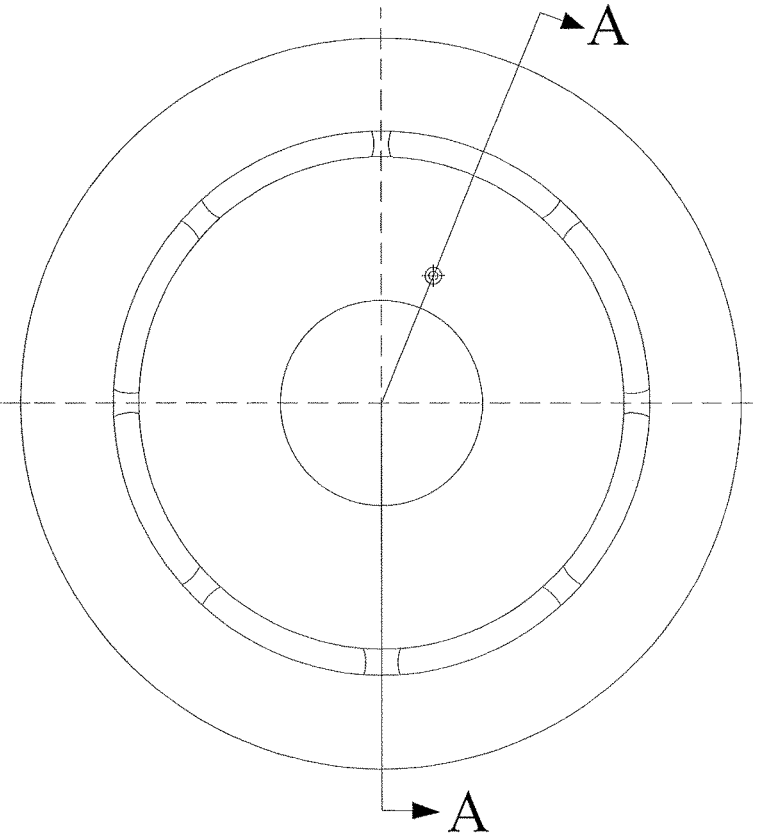
Figure 7:
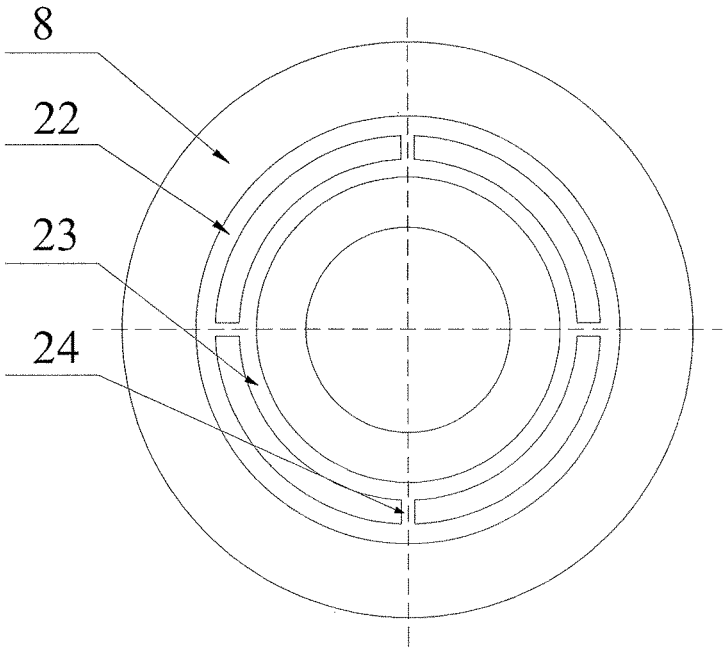
FIG. 7 is an arrangement diagram of a heat pipe grinding wheel in the first embodiment.
Figure 11:
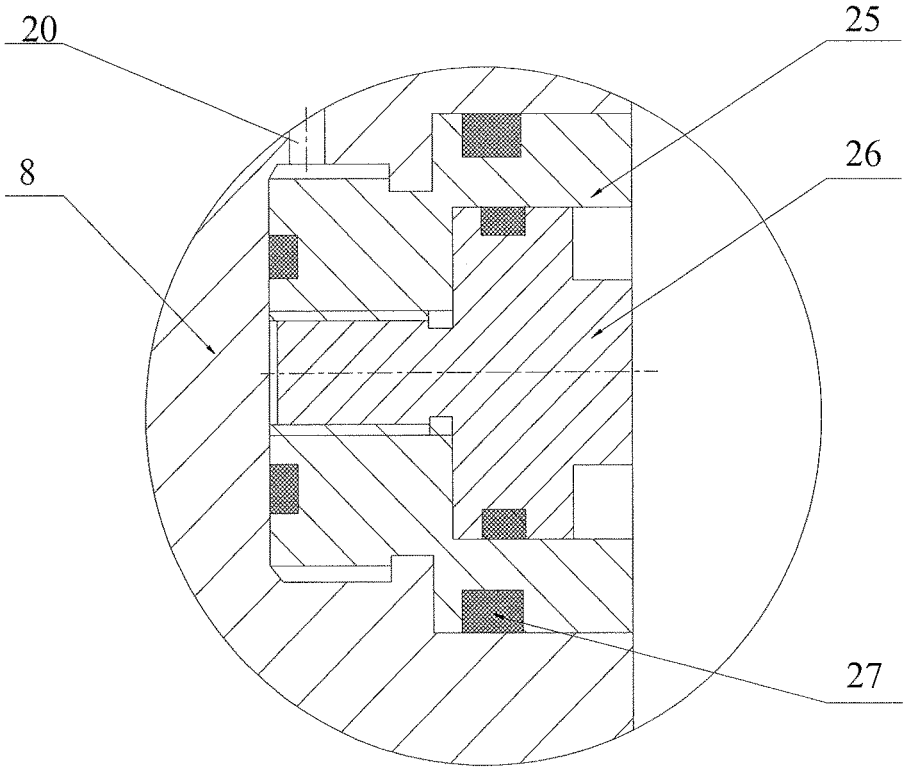
FIG. 11 is a section view of a vacuum seal of the heat pipe grinding wheel in the first, second, third and fourth embodiments.

FIG. 6*a* and FIG. 6*b* are a rotary section view and a front view of a structure of the heat pipe grinding wheel, and the heat pipe grinding wheel is mainly composed of a sealing cover plate 19, a degassing hole 20, a vacuum seal 21, and a cambered heat pipe outer ring 22, a cambered heat pipe inner ring 23 and a communication pipe 24 of cambered heat pipe inner and outer rings in FIG. 7. FIG. 11 is a section view of the vacuum seal of the heat pipe grinding wheel, and the vacuum seal is composed of a seal joint 25, a plug 26 and a sealing ring 27. The cambered heat pipe outer ring 22 is located on the edge of the heat pipe grinding wheel, and the cambered heat pipe inner ring 23 is away from the edge of the grinding wheel; the outer ring is a heat absorption end and can absorb the temperature in the grinding area and the temperature absorbed by the electrocaloric film material from the grinding area through a phase change refrigeration function of the fluid for cooling; and the cambered inner ring is a heat dissipation end for releasing the absorbed heat.

Figure 12:
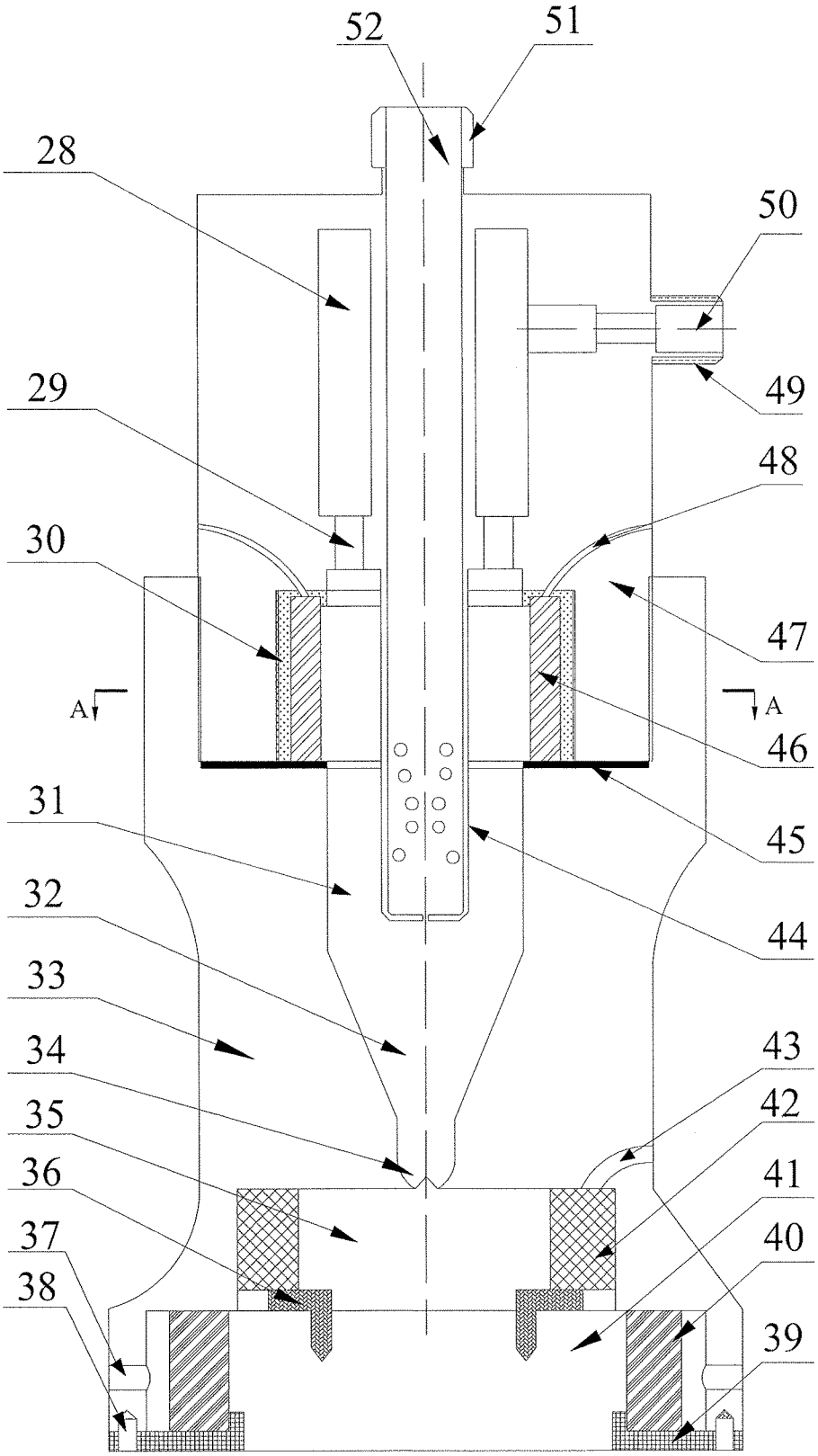
FIG. 12 is a section view of a structure of a combined nozzle in the first, second, third and fourth embodiments.
Figure 13:
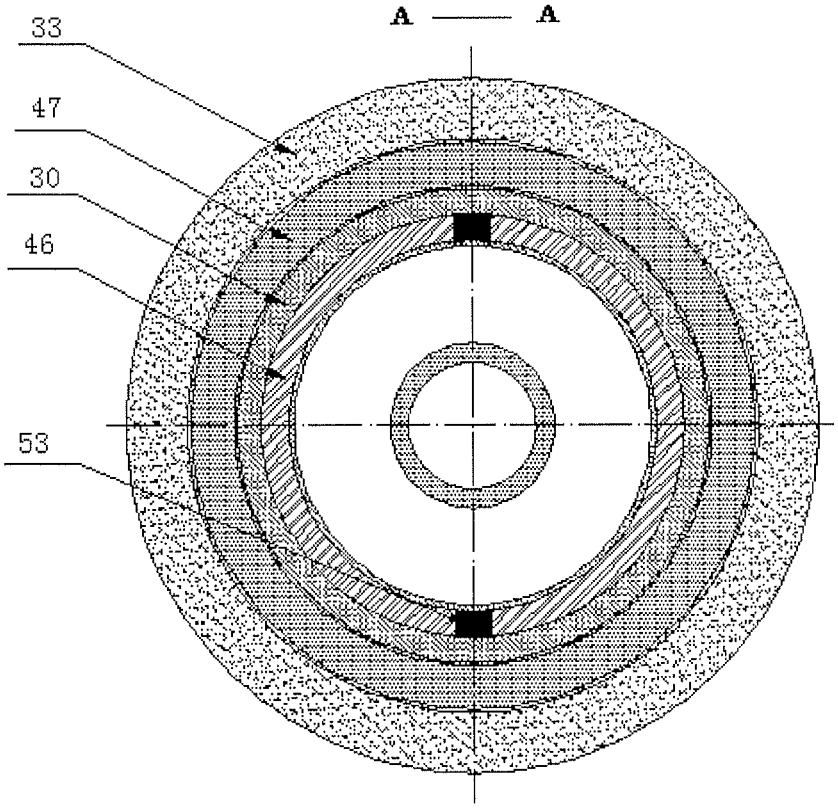
FIG. 13 is a section view at an assembly site of upper and lower nozzle bodies of the combined nozzle in the first, second, third and fourth embodiments.
Figure 14:
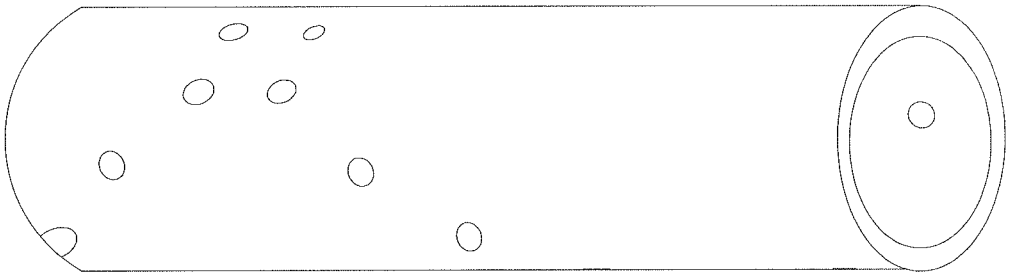
FIG. 14 is an isometric diagram of a combined nozzle gas injection pipe in the first, second, third and fourth embodiments.

FIG. 12 and FIG. 13 are a section view of the structure of the combined nozzle 15 and a section view at an assembly site of upper and lower nozzle bodies of the combined nozzle, the combined nozzle 15 includes an upper nozzle body 47 of the combined nozzle and a lower nozzle body 33 of the combined nozzle, which are connected by threads, the electric field plate electrode is installed in the upper nozzle body for providing a refrigeration hot end for the electrocaloric nano-powder material to reduce the temperature through the nanofluid; the lower nozzle body of the combined nozzle is provided with a corona charging device and a magnet for increasing the charge quantity of the nanofluid droplets; wherein, the upper nozzle body 47 of the combined nozzle includes a combined nozzle liquid injection cavity 28, a combined nozzle orifice 29, a combined nozzle gas injection pipe wall 44, a high-voltage conducting wire channel 48 of the combined nozzle plate electrode, a liquid injection channel joint 49 of the combined nozzle, a liquid injection channel 50 of the combined nozzle, a gas injection channel joint 51 of the combined nozzle and a gas injection channel 52 of the combined nozzle; a combined nozzle plate electrode 46 and a plate electrode insulating block 53 are embedded in an insulating sleeve 30 of the combined nozzle plate electrode, and the insulating sleeve 30 of the combined nozzle plate electrode is in threaded connection with the upper nozzle body 47 of the combined nozzle; the lower nozzle body 33 of the combined nozzle includes a combined nozzle mixing cavity 31, a combined nozzle acceleration section 32, a fan-shaped nozzle outlet 34 of the combined nozzle, a combined nozzle electrode groove 35, the L-shaped needle electrode 36, an electromagnet conducting wire channel 37 of the combined nozzle, a combined nozzle fixing threaded hole 38, a locating chuck 39, a magnet 40, a combined nozzle magnet box 41, a circular electrode disk 42 of the combined nozzle and a high-voltage electrode conducting wire channel 43 of the combined nozzle; and the upper nozzle body 47 of the combined nozzle and the lower nozzle body 33 of the combined nozzle are connected together by threads and the space therebetween is sealed by a sealing washer 45 to constitute an overall structure of the combined nozzle 15. Compressed air enters the combined nozzle mixing cavity 31 through the gas injection channel 52 of the combined nozzle, and meanwhile, the nanofluid enters the combined nozzle liquid injection cavity 28 through the liquid injection channel 50 of the combined nozzle and enters the combined nozzle mixing cavity 31 to be mixed with the compressed air after passing through the combined nozzle orifice 29. The combined nozzle orifice 29 is used for limiting the quantity of the nanofluid entering the combined nozzle mixing cavity 31, so that the compressed air and the nanofluid have an enough mixing space in the combined nozzle mixing cavity 31. The compressed air and the nanofluid are fully mixed in the combined nozzle mixing cavity 31 to form subsonic three-phase (compressed air, liquid lubrication base oil and solid nanoparticle) bubble flow. After the bubble flow enters the combined nozzle acceleration section 32, the combined nozzle acceleration section 32 is of a conical structure, so the flow space of the three-phase bubble flow is reduced, and then the pressure and the flow velocity of the three-phase bubble flow are increased, and the diameter of the bubble is decreased. Meanwhile, the three-phase bubble flow is extruded to lose stability when flowing by the combined nozzle acceleration section 32 and cracks into smaller bubbles and droplets, thereby increasing the number of fog drops and improving the atomization effect. Meanwhile, after being accelerated, the three-phase bubble flow is jet out from the fan-shaped nozzle outlet 34 of the combined nozzle at a near-sonic speed, thereby accelerating the jet flow speed, since the pressure suddenly drops to the atmospheric pressure, the bubbles will violently expand and burst to form liquid atomization power, and meanwhile, the surrounding bubbles will be impacted to burst and mutually collide to make the atomization particles become very tiny. A gas injection hole is formed on the combined nozzle gas injection pipe wall 44, the arrangement of the gas injection hole is as shown in FIG. 14, this arrangement is more beneficial for the three-phase bubble flow being fully mixed and colliding in the combined nozzle mixing cavity 31, meanwhile, the central axis of the gas injection hole and the central axis of the nozzle gas injection pipe form an inclination angle of 15-35 degrees, which is beneficial for the three-phase bubble flow in the combined nozzle mixing cavity 31 to advance towards the combined nozzle acceleration section 32, and an axial gas injection hole is formed at the top end of the combined nozzle gas injection pipe wall 44 for further accelerating the three-phase bubble flow in the combined nozzle acceleration section 32.

Figure 15:
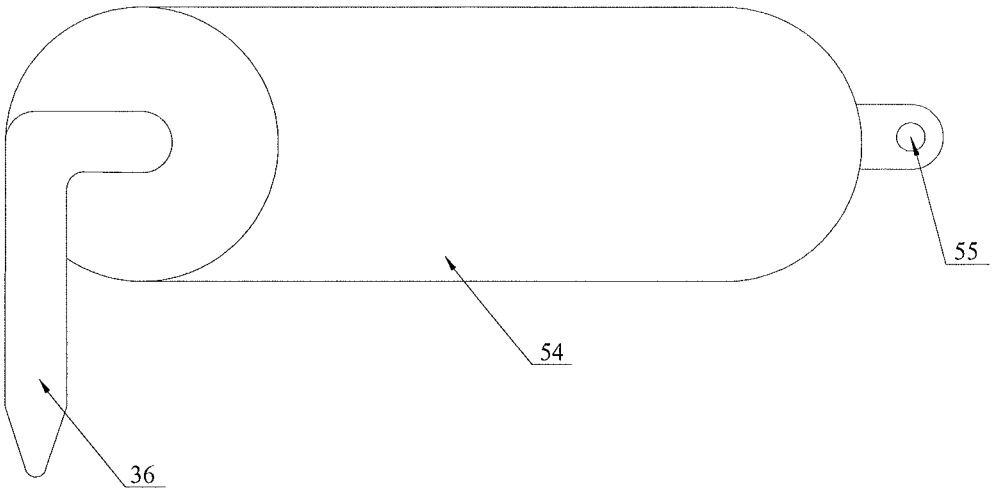
FIG. 15 is an isometric diagram of an L-shaped needle electrode and a rubber stopper in the first, second, third and fourth embodiments.
Figure 16A:
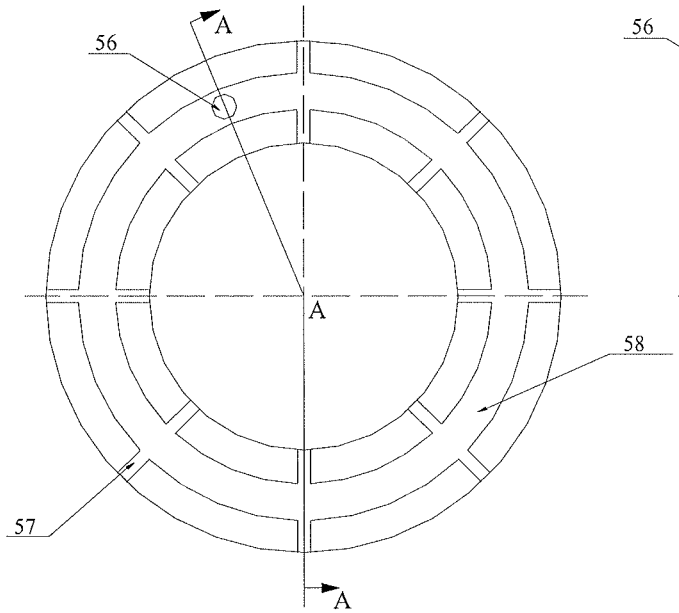
FIG. 16*a* and FIG. 16*b* are a top view and a rotary section view of a circular electrode groove of the combined nozzle in the first, second, third and fourth embodiments.
Figure 16B:
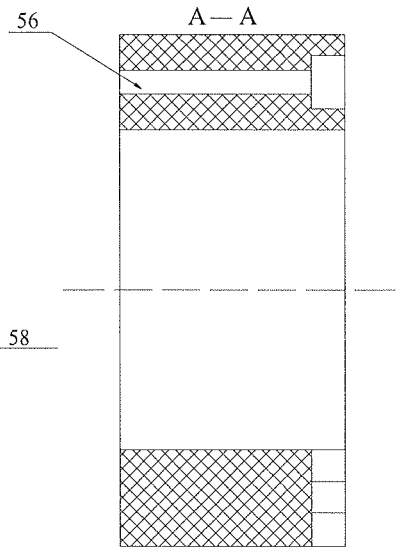
Figure 17:
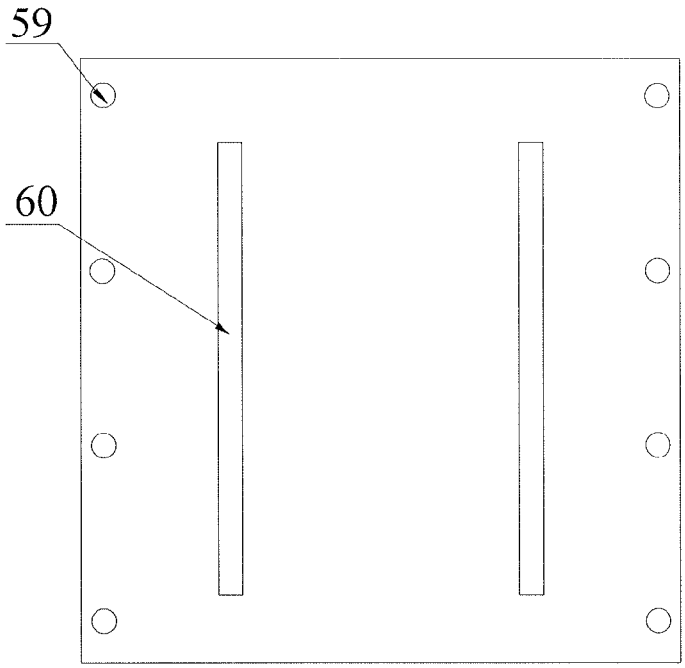
FIG. 17 is a top view of a magnet locating chuck of the combined nozzle in the first, second, third and fourth embodiments.

FIG. 15, FIG. 16 and FIG. 17 are an isometric diagram of the L-shaped needle electrode and a rubber stopper, a top view and a rotary section view of a circular electrode groove of the combined nozzle and a top view of a magnet locating chuck of the combined nozzle; the circular electrode disk 42 of the combined nozzle is made of a rubber material and has certain elasticity, 4-8 needle electrode necks 57 are arrayed on the circumference thereof, a high-voltage electrode conducting wire placement groove 58 is arranged on the circular electrode disk 42 of the combined nozzle, a high-voltage electrode conducting wire through hole 56 is arranged in the electrode conducting wire placement groove 58 to conveniently lead out the high-voltage electrode conducting wire, and after being led out, the high-voltage electrode conducting wire is connected to the outside of the combined nozzle 15 by the high-voltage electrode conducting wire channel 43 of the combined nozzle. The L-shaped needle electrodes 36 are inserted in the needle electrode necks 57 (interference fit). The circular electrode disk 42 of the combined nozzle with the connected electrode is placed in the combined nozzle electrode groove 35, the magnet 40 is placed in the combined nozzle magnet box 41 and is located by the locating chuck 39, and a magnet baffle 60 is arranged on the locating chuck 39 for limiting the magnet. The magnet 40 can be a permanent magnet and can also be an electromagnet, and if the magnet is the electromagnet, an electromagnet conducting wire is lead out by the electromagnet conducting wire channel 37 of the combined nozzle.

Figure 18:
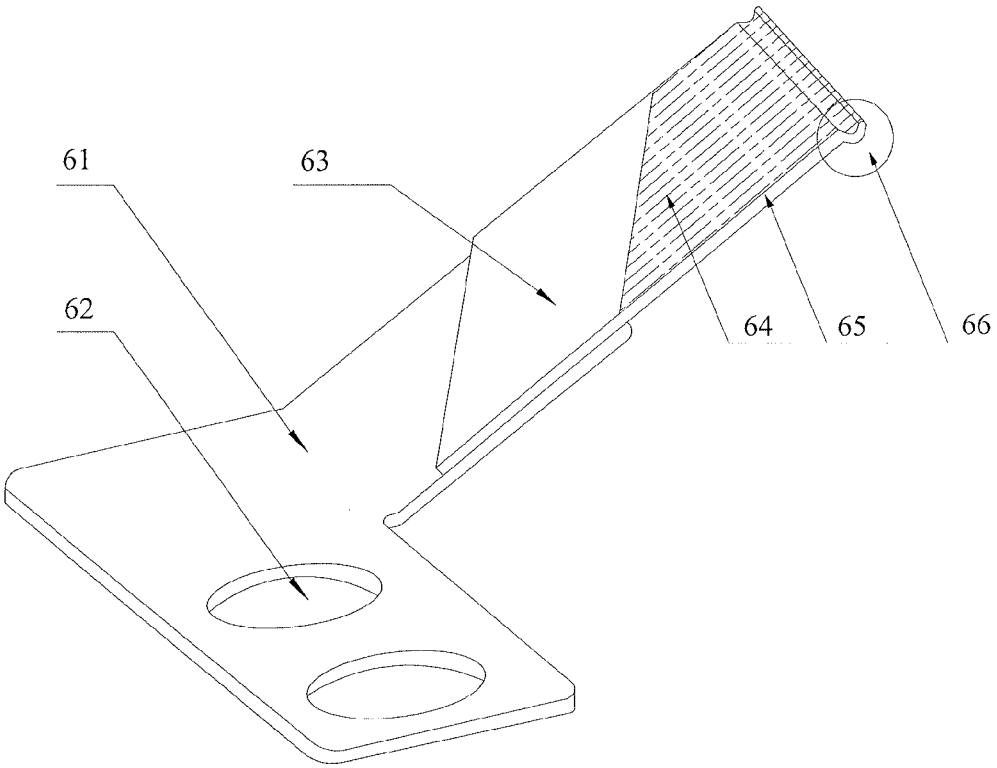
FIG. 18 is an isometric diagram of an overall structure of an electric brush base and an entirety in the first, second, third and fourth embodiments.
Figure 19:
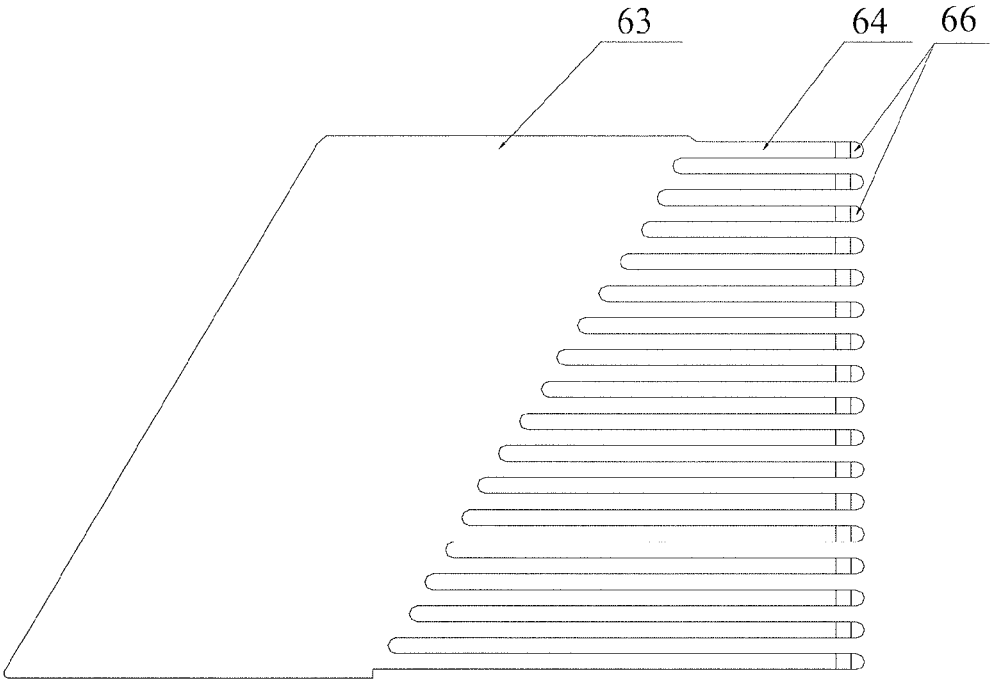
FIG. 19 is a top view of an electric brush in the first, second, third and fourth embodiments.
Figure 20:
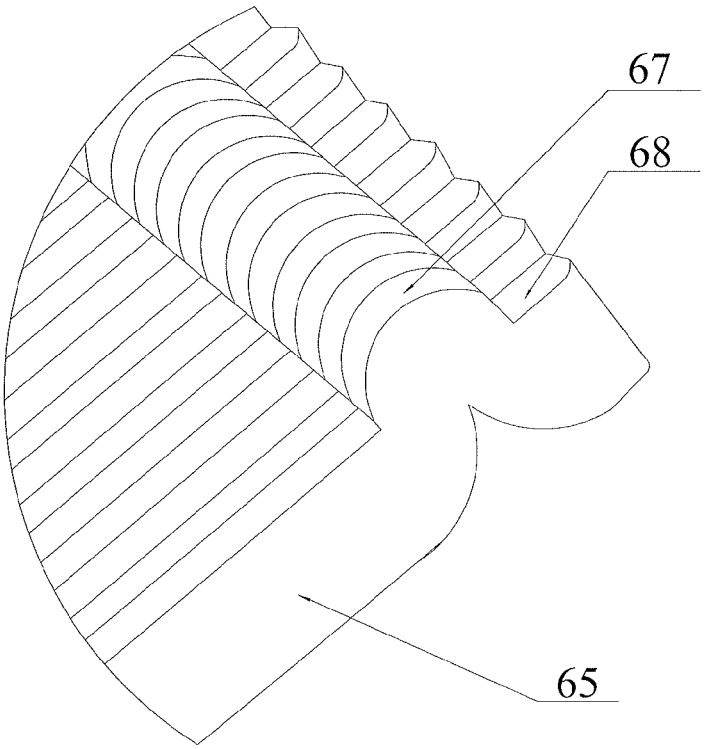
FIG. 20 is a partial enlarged drawing of the electric brush in the first, second, third and fourth embodiments.

FIG. 18 to FIG. 20 are structure diagrams of the electric brush, and the electric brush includes an electric bush base 61, an electric bush fixing through hole 62, a supporting body 63, a conducive part 64, an Sn/Ag elastic contact piece 65, a sliding part 66, a projection part 67 and a protrusion part 68; wherein, the projection part 67 and the protrusion part 68 constitute the sliding part 66.

Figure 21A:
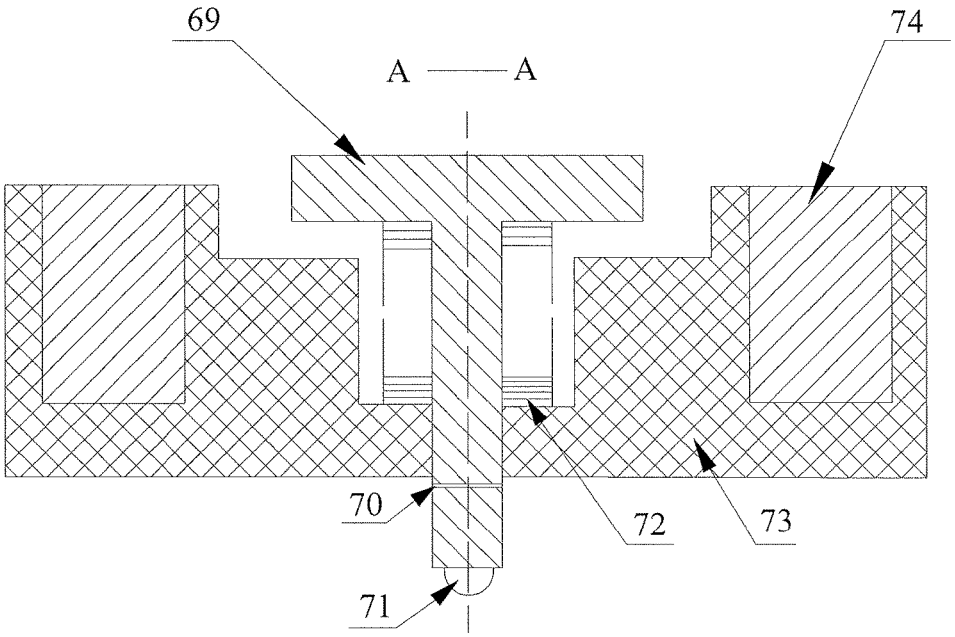
FIG. 21*a* and FIG. 21*b* are a section view and a top view of a workpiece energizing device in the first, second, third and fourth embodiments.
Figure 21B:
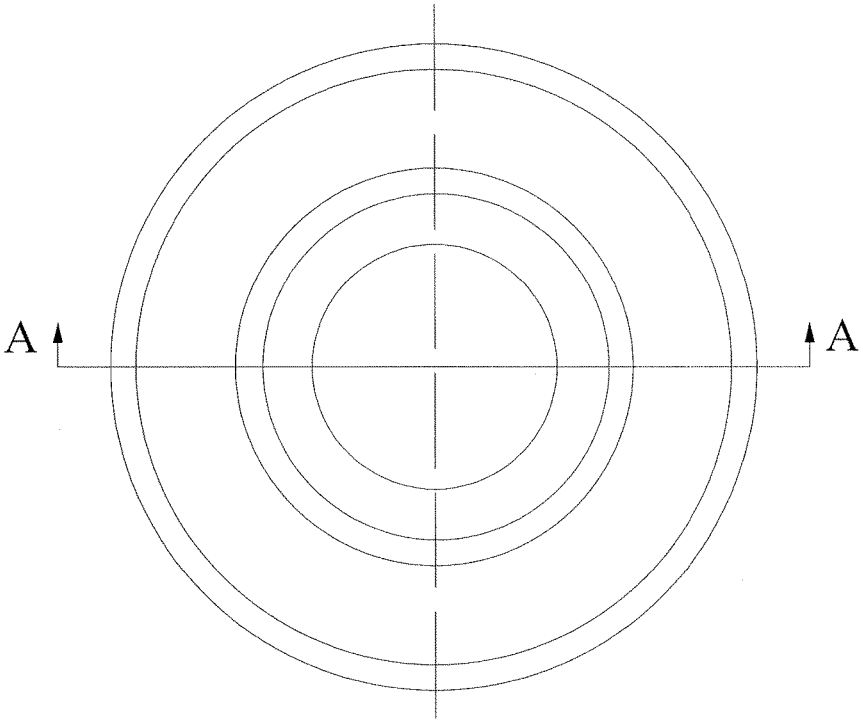

FIG. 21*a* and FIG. 21*b* are a section view and a top view of a workpiece energizing device, and the workpiece energizing device includes a weight 69, a cotter pin slot 70, a conducting wire connecting ring 71, a pressing spring 72, a workpiece energizing device insulating shell 73 and a pressing permanent magnet 74.

Figure 22:
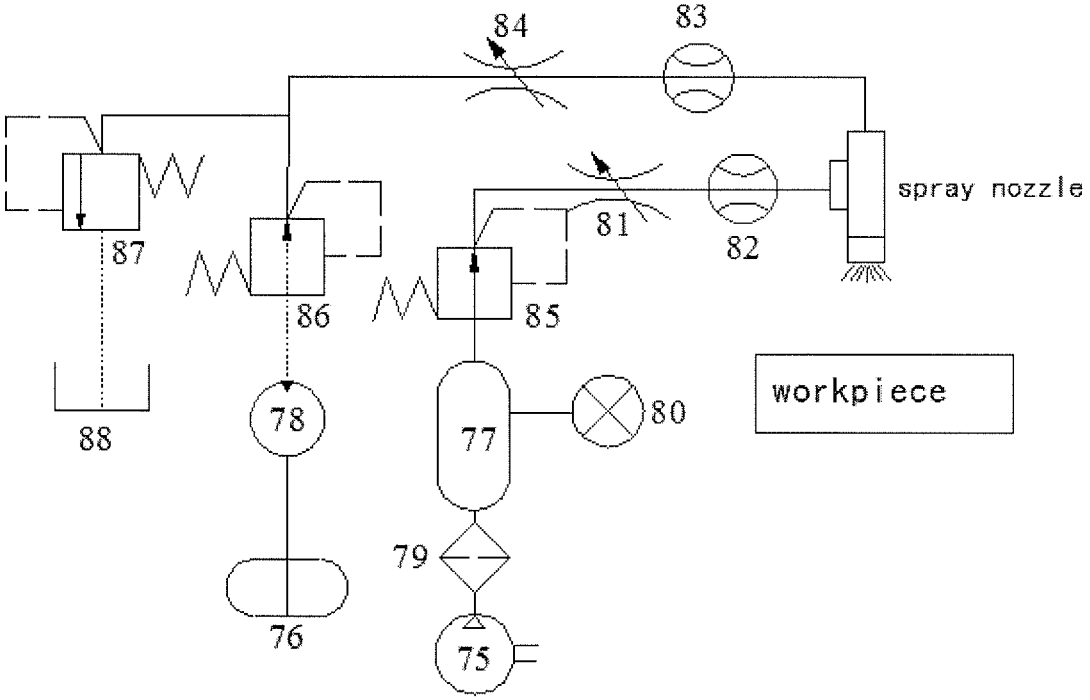
FIG. 22 is an abbreviated drawing of a liquid path and gas path system in the first, second, third and fourth embodiments.

FIG. 22 is an abbreviated drawing of a liquid path and gas path system, and the liquid path and gas path system includes an air compressor 75, a nanofluid storage tank 76, a gas storage tank 77, a hydraulic pump 78, a filter 79, a pressure gage 80, a throttle valve I 81, a turbine flowmeter I 82, a turbine flowmeter II 83, a throttle valve II 84, a pressure regulating valve I 85, a pressure regulating valve II 86, an overflow valve 87 and a nanofluid recycling box 88.

Figure 23:
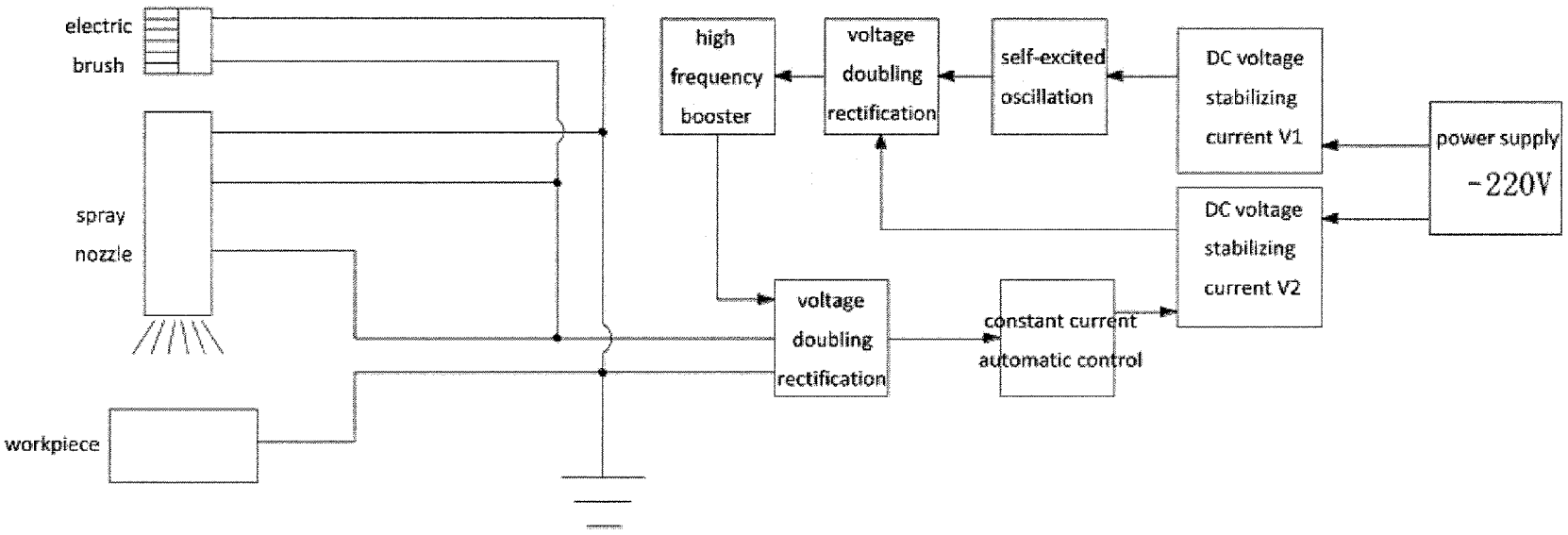
FIG. 23 is a block diagram of a circuit system in the first, second, third and fourth embodiments.

As shown in FIG. 23, the high-voltage DC power supply 14 is composed of an AC power supply input unit, a DC voltage stabilizing unit V1, a DC voltage stabilizing unit V2, a self-excited oscillation circuit, a power amplifier, a high frequency pulse booster, a voltage doubling rectification circuit and a constant current automatic control circuit.

The nanofluid of the electrocaloric nano-powder material is formed by preparing a ferroelectric material into nano-powder and adding the nano-powder into the common nanofluid, the nanofluid grinding fluid with the added electrocaloric nano-powder material is jet out from the spray head of the nozzle to be atomized into droplets, and meanwhile, the droplets are charged under the action of the high-voltage DC electrostatic generator and the magnetic field forming device and are conveyed to the grinding area.

The electrocaloric film material and the electrocaloric nano-powder material can include a ferroelectric material, an antiferroelectric material and a relaxor ferroelectric material, and the Curie temperature of the electrocaloric material is near the room temperature, thereby having a relatively large electrocaloric effect.

The electrothermal temperature change of the electrocaloric material can be obtained by integral derivation by the following method: for most ferroelectric or antiferroelectric dielectric materials, above a transformation temperature, the electric field has important influence on the electric dipole entropy change in the material, and the entropy change can be calculated by the following formula:

$$TdS=C_E dT+T(\partial P/\partial T)_E dE \tag{1}$$

Herein, S refers to the entropy change in a unit volume of the material, and E refers to the external electric field; P refers to polarization intensity; $C_E$ refers to specific heat under a constant electric field; dS refers to the entropy change of the material in the unit volume; T refers to an absolute temperature; and $$\left(\frac{\partial P}{\partial T}\right)_E$$

refers to a pyroelectric coefficient under constant electric field intensity. Under an adiabatic condition, Q=TdS=0, so the calculation formula of the electrothermal temperature change can be deduced from the formula (1):

$$dT=-(T/C_E)(\partial P/\partial T)_E dE \tag{2}$$

Depolarization is carried out under the adiabatic condition, the pyroelectric coefficient $(\partial P/\partial T)_E$ is smaller than zero, and a refrigeration effect can be only generated under the condition that dE is smaller than zero. In general, an electrothermal effect is associated with the pyroelectric effect through the Maxwell equation:

$$\left(\frac{\partial T}{\partial E}\right)_s = \frac{Tp_E}{C_E} \tag{3}$$

In the formula, $$\left(\frac{\partial T}{\partial E}\right)_s$$

expresses the adiabatic temperature change when the electric field intensity is E, T expresses the absolute temperature, $C_E$ expresses the volume specific heat of the material under the constant electric field, $P_E$ expresses the pyroelectric coefficient under constant electric field intensity $$\left(\text{i.e., } \left(\frac{\partial P}{\partial E}\right)_E\right),$$

s expresses the entropy change, and excluding the influence of the secondary electrothermal effect, an electrothermal temperature change equation is deduced as follows:

$$dT=-(T/C_E)P_E dE \tag{4}$$

A formula (2) can also be deduced by substituting the pyroelectric coefficient $$P_E = \left(\frac{\partial P}{\partial E}\right)_E,$$

and then an electrothermal temperature change integral formula is deduced:

$$\Delta T = -\frac{T}{C\rho}\int_{E_1}^{E_2}\left(\frac{\partial P}{\partial T}\right)dE \tag{5}$$

Wherein, ρ refers to material density, C refers to material heat capacity, $C_E=C_P$, $E_1$ refers to the lowest electric field intensity ensuring that $$\left(\frac{\partial P}{\partial E}\right)_E$$

is a negative value, and $E_2$ refers to the maximal field intensity of the material system.

The calculation formula of the charge quantity of corona charging of the droplets is as follows:

$$q = f\left[1 + 2\frac{k-1}{k+2}\right]4\pi\varepsilon_0 Er^2 \tag{6}$$

$$f = \frac{\frac{NeKi}{4\varepsilon_0}t}{\frac{NeKi}{4\varepsilon_0}t + 1}$$

In the formula, q refers to the charge quantity of the droplets, C;

k refers to a dielectric constant of the droplets;

$\in_0$ refers to the dielectric constant of the air, which is about $8.85\times10^{-12}$, $c^2/n\cdot m^2$ E refers to the electric field intensity formed by corona discharge, V/m;

r refers to the radius of the droplets, μm;

N refers to charging ion concentration, particle number/$w^2$;

e refers to electron charge, $1.6\times10^{-19}$; C;

Ki refers to a charging ion mobility, $m^2/(v\cdot s)$; and t refers to a charging retention time, s.

Figure 3A:
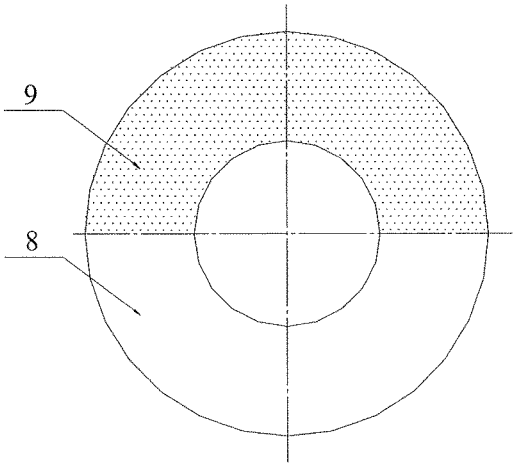
FIG. 3*a* and FIG. 3*b* are a front view and a rear view of arrangement of a ferroelectric film of a grinding wheel in a second embodiment.
Figure 3B:
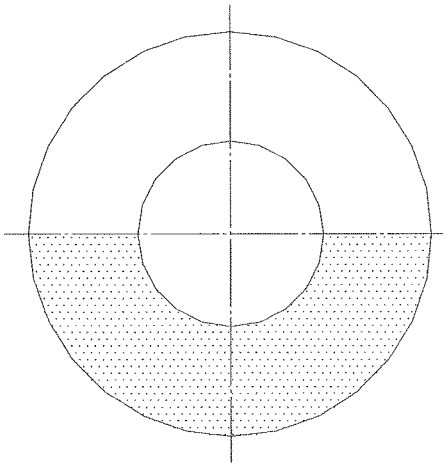
Figure 8:
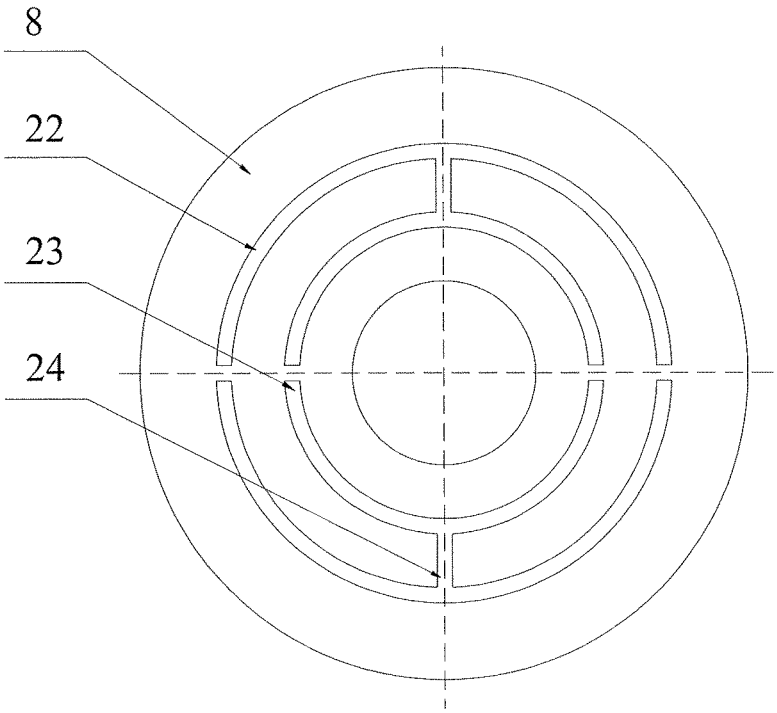
FIG. 8 is an arrangement diagram of the heat pipe grinding wheel in the second embodiment.

The arrangement mode of the electrocaloric film material in the second embodiment of the present invention is as shown in FIG. 3*a* and FIG. 3*b* and the arrangement of the heat pipe is shown by the cooperation mode in FIG. 8; and the power supplies in the embodiment are high-voltage DC power supplies, and other structures are the same as those in the first embodiment.

Figure 4A:
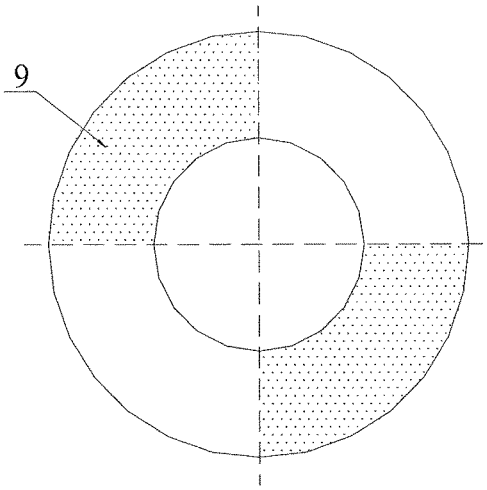
FIG. 4*a* and FIG. 4*b* are a front view and a rear view of arrangement of the ferroelectric film of the grinding wheel in a third embodiment.
Figure 4B:
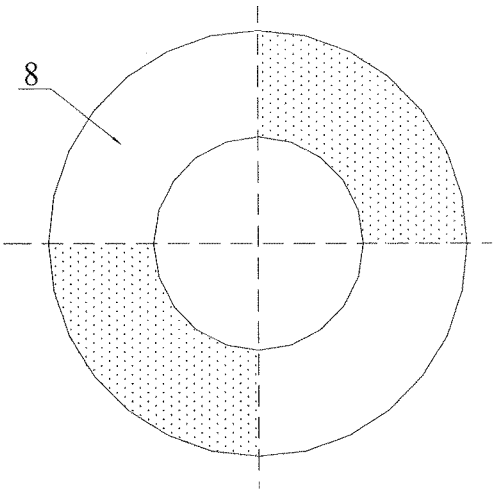
Figure 9:
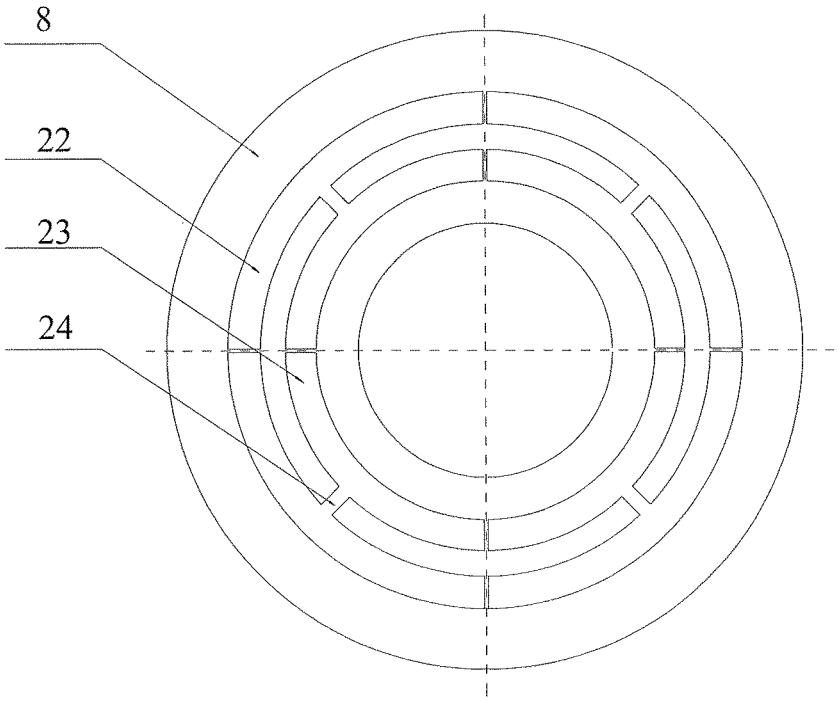
FIG. 9 is an arrangement diagram of the heat pipe grinding wheel in the third embodiment.

The arrangement mode of the electrocaloric film material in the third embodiment of the present invention is as shown in FIG. 4*a* and FIG. 4*b* and the arrangement of the heat pipe is shown by the cooperation mode in FIG. 9; and the power supplies in the embodiment are high-voltage DC power supplies, and other structures are the same as those in the first embodiment.

Figure 5A:
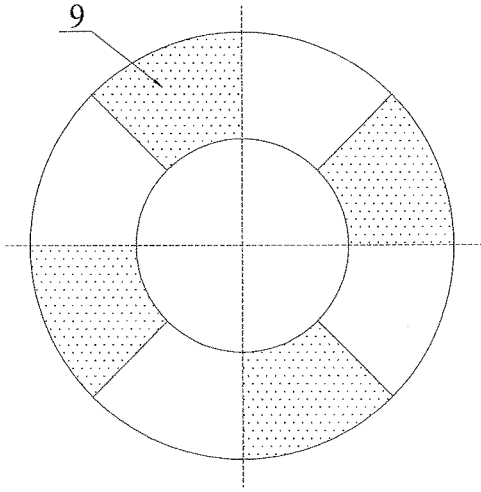
FIG. 5*a* and FIG. 5*b* are a front view and a rear view of arrangement of the ferroelectric film of the grinding wheel in a fourth embodiment.
Figure 5B:
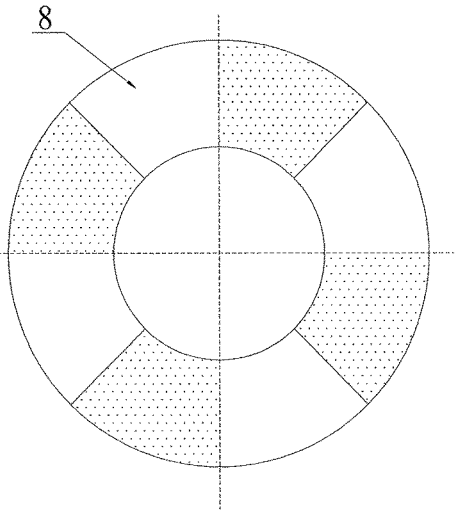
Figure 10:
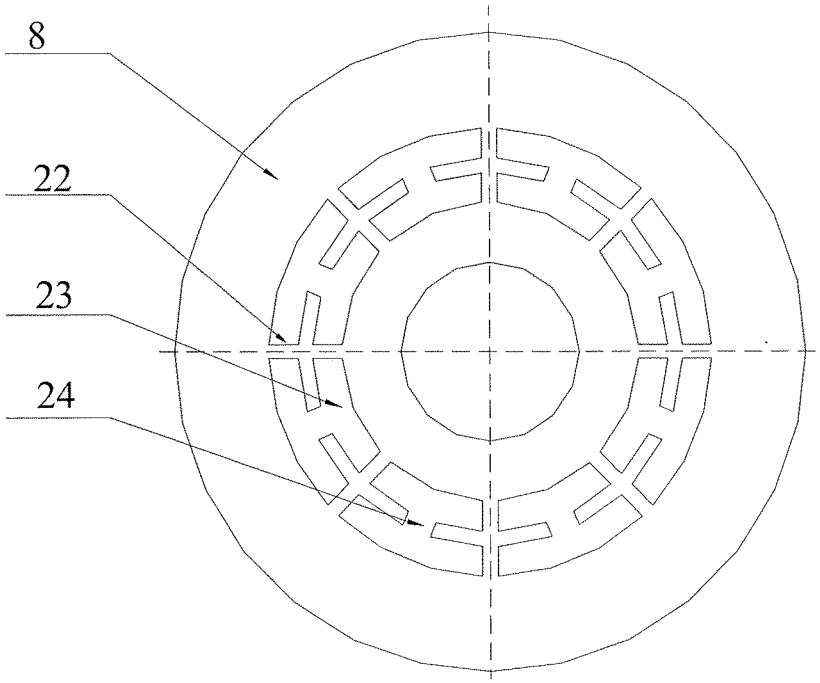
FIG. 10 is an arrangement diagram of the heat pipe grinding wheel in the fourth embodiment.

The arrangement mode of the electrocaloric film material in the fourth embodiment of the present invention is as shown in FIG. 5*a* and FIG. 5*b* and the arrangement of the heat pipe is shown by the cooperation mode in FIG. 10; and the power supplies in the embodiment are high-voltage DC power supplies, and other structures are the same as those in the first embodiment.

The specific working procedure of the present invention is as follows:

a workpiece 2 to be ground is sucked on a magnetic worktable 1, and the positive electrode and the negative electrode of the electric brush 7 fixed on the grinding wheel cover are respectively in contact with the electrocaloric film material 9 on both side surfaces of the heat pipe grinding wheel 8 to form a high-voltage electric field, in order to serve as a refrigeration hot end; when the electrocaloric film material 9 rotates to the space between the positive electrode and the negative electrode of the electric brush 7 together with the heat pipe grinding wheel 8, the electrocaloric film material is quickly polarized under the action of the external electric field, its temperature rises, meanwhile, the refrigeration fluid in the cambered heat pipe outer ring 22 absorbs the heat generated by the electrocaloric film material 9 to recover the electrocaloric film material to a normal temperature state, and the refrigeration fluid is gasified after absorbing the heat and enters the cambered heat pipe inner ring 23 through the communication pipe 24 of cambered heat pipe inner and outer rings to release heat to be liquefied; when the electrocaloric film material 9 leaves the space between the positive electrode and the negative electrode of the electric brush 7 together with the heat pipe grinding wheel 8, its temperature drops and is lower than the ambient temperature, the electrocaloric film material absorbs the grinding heat when arriving at the grinding area (the refrigeration cold end), and disperses the heat absorbed in the grinding area when rotating to the high-voltage electric field of the electric brush 7 again to finish a Carnot cycle, and the circulation is continuously carried out to absorb the heat in the grinding area for refrigerating and reducing the temperature of the grinding area; meanwhile, the electrocaloric film material 9 can also absorb the heat transferred into the grinding wheel to refrigerate and cool the grinding wheel body; a high-voltage pulse power supply is applied to the electrocaloric film material 9 in the first embodiment, while the high-voltage DC power supply is applied to the electrocaloric film material 9 in the second, third and fourth embodiments, so as to complete the Carnot cycle and achieve a refrigeration effect; and in the second, third and fourth embodiments, since a plurality of refrigeration sheets circularly work, the refrigeration effect is better. At the same time, when dissipating the heat of the electrocaloric film material 9, the heat pipe can also refrigerate the grinding area; the refrigeration fluid in the cambered heat pipe outer ring 22 absorbs the heat generated by the grinding area, and the refrigeration fluid is gasified after absorbing the heat, enters the cambered inner ring 23 through the communication pipe 24 of cambered heat pipe inner and outer rings to release heat to be liquefied, and flows back into the cambered heat pipe outer ring 22 through the communication pipe 24 of cambered heat pipe inner and outer rings to continue to absorb the heat. The nanofluid with the added electrocaloric nano-powder material enters the combined nozzle liquid injection cavity 28 through the liquid injection channel 50 of the combined nozzle and is quickly polarized under the electric field formed by the combined nozzle plate electrode 46 after passing by the combined nozzle orifice 29, the temperature of the electrocaloric nano-powder material rises and recovers to the room temperature through the heat exchange ability of the nanofluid, then the electrocaloric nano-powder material enters the combined nozzle mixing cavity 31 to be mixed with the compressed air, after leaving the electric field, the temperature of the electrocaloric nano-powder material drops to reduce the overall temperature of the nanofluid, and the electrocaloric nano-powder material enters a magnetically enhanced corona charging area through the combined nozzle acceleration section 32 and the fan-shaped nozzle outlet 34 of the combined nozzle to be charged by the L-shaped needle electrode 36, and enters the grinding area in the electrostatic atomization mode to absorb the grinding heat in the grinding area, so as to reduce the grinding temperature.

Although the specific implementations of the present invention have been described above in combination with the accompany drawings, the protection scope of the present invention is not limited hereto, those skilled in the art to which the present invention belongs should understand that, a variety of modifications or variations, made by those skilled in the art based on the technical solutions of the present invention without any creative effort, shall still fall into the protection scope of the present invention.

The invention claimed is:

1. A minimal quantity lubrication grinding device integrating nanofluid electrostatic atomization with an electrocaloric heat pipe, comprising:

a heat pipe grinding wheel covered with an electrocaloric film material on both side surfaces, wherein an external electric field is applied to the outside of the electrocaloric film material; and an electrostatic atomization combined nozzle provided with a high-voltage DC electrostatic generator and a magnetic field forming device at the outside and in an electrocaloric refrigeration and magnetically enhanced electric field;

the electrostatic atomization combined nozzle is respectively connected with a nanoparticle liquid supply system and a gas supply system; and nanofluid is electrostatically atomized by the electrostatic atomization combined nozzle and is jet to a grinding area to absorb the heat of the grinding area; the electrocaloric film material absorbs the heat in the grinding area through an electrocaloric effect and disperses the absorbed heat through the heat pipe grinding wheel after leaving the grinding area to form a Carnot cycle.

2. The minimal quantity lubrication grinding device integrating the nanofluid electrostatic atomization with the electrocaloric heat pipe of claim 1, wherein an electric brush with an Sn/Ag electrode is arranged at the outside of the electrocaloric film material, and the external electric field is applied by the electric brush; the electric brush is fixed on a grinding wheel cover, and a positive electrode and a negative electrode of the electric brush are respectively in contact with the electrocaloric film material on both side surfaces of the heat pipe grinding wheel; a high-voltage electric field is formed between the positive electrode and the negative electrode of the electric brush and serves as a refrigeration hot end for releasing the heat through a heat pipe; and the grinding area is a refrigeration cold end and absorbs the heat through the electrocaloric film material.

3. The minimal quantity lubrication grinding device integrating the nanofluid electrostatic atomization with the electrocaloric heat pipe of claim 2, wherein the electrocaloric film material covers the entire outer surface of the heat pipe grinding wheel or covers a half of the area of the outer surface of the heat pipe grinding wheel; and the heat pipe of the heat pipe grinding wheel comprises a cambered inner ring and a cambered outer ring, which are communicated at the middle, the cambered outer ring is arranged on the edge of the heat pipe grinding wheel, and the cambered inner ring is away from the edge of the grinding wheel.

4. The minimal quantity lubrication grinding device integrating the nanofluid electrostatic atomization with the electrocaloric heat pipe of claim 1, wherein the electrostatic atomization combined nozzle comprises an upper nozzle body and a lower nozzle body, and the upper nozzle body and the lower nozzle body are fixedly connected and are provided with sealing devices.

5. The minimal quantity lubrication grinding device integrating the nanofluid electrostatic atomization with the electrocaloric heat pipe of claim 4, wherein combined nozzle plate electrodes are arranged in the upper nozzle body, a plate electrode insulating block is arranged for isolation between the combined nozzle plate electrodes, and an insulating sleeve is sleeved on the outer side of the combined nozzle plate electrodes; a combined nozzle gas injection pipe is arranged in the upper nozzle body, and the combined nozzle gas injection pipe is communicated to the outside of the electrostatic atomization combined nozzle and is connected with a compressed air conveying serpentuator; and a combined nozzle liquid injection cavity is further arranged in the upper nozzle body, the lower part of the combined nozzle liquid injection cavity is connected with a combined nozzle orifice, and the combined nozzle liquid injection cavity is communicated to the outside of the electrostatic atomization combined nozzle through a pipeline and is connected with a nanofluid conveying serpentuator; and a gas injection hole is formed on the pipe wall of the combined nozzle gas injection pipe, and the central axis of the gas injection hole and the central axis of the combined nozzle gas injection pipe form an inclination angle of 15-35 degrees.

6. The minimal quantity lubrication grinding device integrating the nanofluid electrostatic atomization with the electrocaloric heat pipe of claim 4, wherein a combined nozzle mixing cavity is arranged in the lower nozzle body, and both ends of the combined nozzle mixing cavity are respectively connected with the combined nozzle gas injection pipe and a fan-shaped nozzle, and a conical acceleration section is arranged between the combined nozzle mixing cavity and the fan-shaped nozzle; and the high-voltage DC electrostatic generator and the magnetic field forming device are installed at the lower part of the fan-shaped nozzle.

7. The minimal quantity lubrication grinding device integrating the nanofluid electrostatic atomization with the electrocaloric heat pipe of claim 1, wherein the high-voltage DC electrostatic generator is connected with the negative electrode of an adjustable high-voltage DC power supply, and the positive electrode of the adjustable high-voltage DC power supply is connected with a workpiece energizing device attached to a non-machined surface of the workpiece to form a negative corona discharge form; and the magnetic field forming device is located around a corona discharge area, and a magnet is fixed below L-shaped needle electrodes through a locating chuck to form field intensity at the middle to improve the charge quantity of nanofluid droplets.

8. The minimal quantity lubrication grinding device integrating the nanofluid electrostatic atomization with the electrocaloric heat pipe of claim 2, wherein the electric brush comprises an electric brush base, and the electric brush base is fixed on the grinding wheel cover; the electric brush base is connected with a supporting body, a conductive part is arranged at the front end of the supporting body, an Sn/Ag elastic contact piece is arranged on the conductive part, and a sliding part is arranged at the front end of the conductive part; a projection part is arranged on the sliding part; the power supply of the electric brush and the power supply of the combined nozzle plate electrode are connected with the adjustable high-voltage DC power supply, and a power supply signal conversion device is arranged between the power supply of the combined nozzle plate electrode and the adjustable high-voltage DC power supply.

9. The minimal quantity lubrication grinding device integrating the nanofluid electrostatic atomization with the electrocaloric heat pipe of claim 7, wherein the workpiece energizing device comprises a workpiece energizing device insulating shell, a weight, a pressing permanent magnet and a pressing spring; the pressing permanent magnet is arranged on the workpiece energizing device insulating shell, the weight is arranged at the middle of the workpiece energizing device insulating shell through the pressing spring in a penetration manner, and a conducting wire connecting ring and a cotter pin slot are arranged at the end part exposed from the workpiece energizing device insulating shell.

10. The minimal quantity lubrication grinding device integrating the nanofluid electrostatic atomization with the electrocaloric heat pipe of claim 1, wherein the electrocaloric film material and an electrocaloric nano-powder material are ferroelectric materials, antiferroelectric materials or relaxor ferroelectric materials.

* * * * *